United States Patent [19]

Kimbrell, Jr.

[11] 4,329,389

[45] May 11, 1982

[54] POLYESTER TEXTILE MATERIALS HAVING IMPROVED DURABLE SOIL RELEASE CHARACTERISTICS AND PROCESS FOR PRODUCING SAME

[75] Inventor: William C. Kimbrell, Jr., Inman, S.C.

[73] Assignee: Milliken Research Corporation, Spartanburg, S.C.

[21] Appl. No.: 137,207

[22] Filed: Apr. 4, 1980

[51] Int. Cl.[3] ..... B32B 7/00; D03D 3/00; B05D 3/02

[52] U.S. Cl. ..... 428/263; 427/381; 427/393.4; 428/265; 428/288; 428/290; 252/8.7

[58] Field of Search ..... 427/393.4, 381; 8/115.6; 428/290, 265, 263, 288; 268/29,2 E

[56] References Cited

U.S. PATENT DOCUMENTS

| | | |
|---|---|---|
| 3,293,178 | 12/1966 | MacDonald et al. . |
| 3,433,666 | 3/1969 | Moyse et al. . |
| 3,574,620 | 4/1971 | Tesoro . |
| 3,716,518 | 2/1973 | Pittman et al. . |
| 3,734,874 | 5/1973 | Kibler et al. . |
| 3,798,169 | 3/1974 | Dickson et al. . |
| 3,912,681 | 10/1975 | Dickson . |
| 3,993,830 | 11/1976 | Dickson et al. . |
| 4,131,550 | 12/1978 | Marco . |

OTHER PUBLICATIONS

*Precipitation of Polyelectrolytes by Salts,* Ikegami et al., pp. 133–152, 1962, vol. 56, Journal of Polymer Science.

*Metal Containing Cured Resins Based on Divalent Metal Salts of Ethylene Glycol–Methacrylate–Maleate,* Matsuda et al., 1978, pp. 628–633.

*Poly(Metal Acrylate) Finishes For Antibacterial Cotton,* Rowland et al., 1976, pp. 46, 47, Southern Region Agricultural Research Service, New Orleans, LA.

*The Crosslinking Reaction of Carboxyl Emulsion Particles by Metallic Salts,* Matsumoto et al., 1973, pp. 229–238.

*Configurational Effects on Binding of Magnesium to Polyacrylic Acid,* Jacobson, pp. 321–336, 1962, vol. 57, Journal of Polymer Science.

*Primary Examiner*—Michael R. Lusignan

*Attorney, Agent, or Firm*—H. William Petry; Terry T. Moyer

[57] ABSTRACT

Textile materials comprising polyester fibers having improved durable soil release characteristics are provided by padding the textile material with an effective amount of polymer solution comprising from about 0.05 to about 5 weight percent based on the weight of the solution of a sulfonated polyester polymer, and at least about 10 percent based upon the weight of the sulfonated polyester polymer of a water-soluble salt in which the cation moiety of the salt is a polyvalent metal ion of magnesium, zinc, or calcium. The aqueous solution is padded onto the textile material in an amount sufficient to provide at least about 0.05 weight percent solids on the textile material, such solids being a combination of the sulfonated polyester and the salt constituent. The resulting wet textile material may thereafter be dried to remove substantially all of the water and thereafter the dry textile material may be heated to a temperature sufficient to heat set the fabric and cure the polymer containing the salt constituent.

12 Claims, No Drawings

POLYESTER TEXTILE MATERIALS HAVING IMPROVED DURABLE SOIL RELEASE CHARACTERISTICS AND PROCESS FOR PRODUCING SAME

This invention relates to textile materials formed of polyester fibers having durable soil release characteristics. In one aspect it relates to a method for imparting durable soil release characteristics to a textile material formed of polyester fibers.

Much research effort has been directed to improving the soil release characteristics of textile materials produced from synthetic fibers, such as polyester, without adversely affecting the hand and other essential properties of the textile material. Of major concern has been the difficulty of cleaning garments made from polyester fibers using conventional home washing procedures due to the hydrophobic nature of the polyester fibers. Thus, numerous efforts have been proposed to alter the hydrophobic properties of polyester fiber containing textile materials so that dirt and/or oily deposits can readily be removed in home washing. In altering the hydrophobic characteristics of the textile material, however, care must be exercised to ensure that the hand of the fabric does not become so harsh as to result in discomfort to the wearer of the garment.

There have been attempts to use blends containing synthetic fibers and naturally occurring fibers in order to produce a fabric which possesses the desired soil release and hand properties. Thus, attempts have been made to reduce the hydrophobic characteristics of synthetic fibers, such as polyester, by coating the fibers with a coating that is hydrophilic, i.e., one which will allow the removal of soil or oily materials from the fiber during washing. Many polymer systems have been proposed which are capable of forming a film around the fibers that constitute the textile material, particularly acid emulsion polymers prepared from organic acids having reactive points of unsaturation. Typical of such acid emulsion polymers are those set forth in U.S. Pat. No. 3,377,249 wherein soil release and durable press characteristics of linear polyester fibers are improved by application of an admixture comprising an aminoplast textile resin, a textile resin catalyst and a synthetic acid emulsion polymer. The resulting resin composition is then cured.

In addition, efforts have been made to improve the soil release characteristics of synthetic fibers during home washing. Such a process is set forth in U.S. Pat. No. 3,798,169 wherein a polycarboxylate polymer having an acid equivalent weight of from about 110 to 175 is precipitated from a dilute solution containing such polymer by the use of a water-soluble salt of a polyvalent metal. Thus, the solution polymer is caused to be deposited upon the fabric during the final rinse cycle in the home washing process.

Efforts have also been made to improve the durable soil release characteristics of polyester fibers by applying to the fibers an aqueous emulsion comprising a synthetic acid emulsion polymer, e.g., acrylic copolymers containing various amounts of acrylic or methacrylic acids, and a water-soluble salt, such as magnesium chloride, as disclosed in U.S. Pat. No. 4,131,550. According to the disclosed process the aqueous emulsion is applied to the textile material, e.g., by padding and the resulting wet textile material is then dried to remove water and heated to cure the polymer containing the salt constituent. While the soil release properties obtained on such fabrics have generally been found to be quite good, it has been found to be difficult if not impossible to obtain durable moisture wicking properties on textured polyester fabrics containing such carboxylic acid copolymers, and generally the addition of ethoxylated copolymers is needed to obtain the proper moisture wicking characteristics.

Quite recently, it has been proposed to employ yet another class of polymeric materials, namely sulfonated polyesters on synthetic fabrics as a soil release agent. While very little work has heretofore been done on the use of such sulfonated polymers on synthetic fabrics, recently a product was introduced by 3M Company for application to the fabric by means of a jet dyeing apparatus. This product, sold under the brand name Release FC 227 Fabric Protector, has been found to provide good soil release properties when applied during the dyeing operation, such as by jet dyeing, beck dyeing or even beam dyeing. It has been found, however, that this material is substantially inactive when applied by means of a padding operation. Such application of the finish by padding, however, may be very desirable, such as, for instance, in yarn dyed fabrics or in continuous dyeing operations, such as Thermasol operations, and the like as well as in operations where the textile fabric requires no treatment such as fabrics produced for the printing trade, etc. In all of these operations, of course, a fabric having proper soil release is still desired by the customer and the ultimate user of such fabrics.

While various soil release finishes are available to obtain a padded product having adequate soil release properties, in the preparation of products for the printing trade further restrictions on the use of a particular soil release composition may be imposed by the particular properties in the treated product which are desired or necessary in certain applications. Of particular importance, for instance, are the bleeding and crocking properties obtained on such fabrics after printing. Heretofore, such properties have not been entirely satisfactory using known soil release finishes.

Accordingly, even in view of the above and numerous other processes and compositions which have heretofore been advanced by the prior art, research is constantly being conducted to develop new and improved compositions and processes for imparting durable soil release characteristics to polyester fibers and to textile materials formed therefrom so that garments made of polyester textile materials can readily be cleaned in both a home laundry and a commercial cleaning process. Accordingly, by virtue of the teachings of the present invention, problems historically present with the use of garments produced from textile materials of polyester fibers are substantially alleviated and a durable soil release characteristic is achieved. For instance, according to the present invention a process is provided whereby textile material containing polyester fibers may be imparted with durable soil release characteristics without substantially adversely affecting the hand of the textile material. Furthermore, according to the present invention a textured polyester containing fabric product may be obtained having durable moisture wicking properties, an important property to provide comfort, particularly in prepared-for-print fabrics used to make shirts, blouses, dresses, etc. Moreover, according to the present invention a soil release finish may be applied to a synthetic fabric conveniently and economically by means of a padding operation and the properties provided in the finished product, e.g., bleeding, crocking and lightfastness properties, made according to the invention are those especially desired or necessary for use by the printing trade.

Generally speaking, the present invention is directed to a process for producing textile materials comprising polyester fibers having durable soil release characteristics. Broadly, the process comprises padding onto the textile material an effective amount of an aqueous solution comprising from about 0.05 to about 5 percent, preferably about 0.2 to about 1 weight percent of a sulfonated polyester and at least about 10 weight percent, preferably at least about 20 weight percent based on the weight of the sulfonated polyester of a water-soluble salt in which the cation moiety of the salt is a polyvalent metal ion selected from the group consisting of $Mg^{++}$, $Zn^{++}$ or $Ca^{++}$. While the amount of aqueous solution employed can vary widely, sufficient of the aqueous solution should be used so that the textile material is sufficiently wet with the solution so as to provide at least about 0.05, preferably at least about 0.1 weight percent solids on said material, such solids being the combination and in the beforementioned ratio of the polymer and the water-soluble salt constituent. The wetted fabric may then be dried for a period of time sufficient to remove substantially all of the water and thereafter the dried polymer-salt coated textile material may be heated to a temperature sufficient to cure the polymer containing the salt constituent on the textile substrate. The temperature at which such curing may be carried out may vary widely but may generally be in a range of from about 300° F. to about 450° F., preferably about 350° F. to about 390° F.

Especially desirable results can be obtained when the polymer solution contains from about 0.3 to about 0.7 weight percent of the sulfonated polyester polymer and the salt constituent is present in the solution in an amount of from about 20 to about 25 weight percent based on the weight of the sulfonated polyester polymer. Further, it it desirable that sufficient of the aqueous solution be employed to provide from about 0.05 to about 5 percent, preferably about 0.2 to about 1 weight percent solids on the textile material, e.g., solids being the polymer constituent and the salt constituent.

The sulfonated polyester polymers useful in the practice of the present invention may be selected from a large number of synthetically produced compounds provided sufficient sulfonic acid groups are provided to obtain the surface effects necessary to obtain soil release and moisture wicking properties. The amount of sulfonation may in fact be varied over a broad range to result in either water soluble products such as Release FC 227 Fabric Protector of 3M Company or less water soluble, less highly sulfonated polymers, such as for instance WD size, a sulfonated polyester sold by Eastman Chemicals. Suitable polymers include copolymers of terephthalic acid and its isomers and a suitable glycol such as ethylene glycol, diethylene glycol or other diols or polyols suitable for the production of such products, together with a sulfonated moiety of phthalic acid such as isophthalic acid. Further, the copolymer employed advantageously is capable of of forming a film around the polyester fibers that constitute the textile material.

Synthetically produced copolymers within the scope of the present invention may be conventionally prepared by condensation polymerization as known in the art using known condensation procedures, catalysts and reaction conditions. Suitable di- or polycarboxylic acids which may be used to prepare the polymers include aromatic dicarboxylic acids, such as phthalic, isophthalic and terephthalic acid as well as other suitable aromatic or aromatic-aliphatic dicarboxylic acids such as 1,4 hydro isophthalic dicarboxylic acid and the like. Sulfonated acids used in these copolymers can be any sulfonated dicarboxylic acid, usually the sulfonated monocyclics of the dicarboxylic acids mentioned above are useful in the preparation of these copolymers. As glycols, ethylene glycol, diethylene glycol, propylene glycol or 1,4 butanediol and similar diols can be used.

In all of the copolymers prepared from the above-listed monomers there must be sufficient sulfonic acid groups present to provide the necessary hydrophilic properties to the polyester fibers in conjunction with the use of a divalent metal salt. It should be noted that various mixtures of the above polymers will work according to the process of the present invention and, hence, should be considered within the scope of the present invention.

As noted above, the water-soluble salt which is employed may be any water-soluble salt in which the cation moiety of the salt is a polyvalent metal ion selected from $Mg^{++}$, $Zn^{++}$ or $Ca^{++}$. The anion moiety of the salt may be any moiety which provides the salt in solution form in water. It preferably should be selected so as to avoid coagulation or insolubilization of the sulfonated polyester polymer in such solution, and it should not alter the film-forming properties of the synthetic acid emulsion polymer. It also should not alter the characteristics of the polymer sufficiently to result in the formation of a hard, brittle film. Generally monovalent anionic moieties may prevent or minimize such coagulation or insolubilization of the dissolved or dispersed polymer. The most preferred anionic moieties of the water-soluble salt may be halogens, such as chlorides, bromides and iodides or the anion moiety of a weak organic acid in which the pK value of such acid is from about 3 to about 5. Examples of inorganic, water-soluble salts that may be used are magnesium chloride, magnesium bromide, magnesium iodide, zinc chloride, zinc bromide and zinc iodide, calcium chloride, calcium bromide and calcium iodide. Typical of organic water-soluble salts that may be used are magnesium acetate, calcium acetate, magnesium formate, calcium formate, magnesium citrate, calcium citrate, zinc acetate, zinc formate, zinc citrate, and the like. It should also be noted that various mixtures of the above-described water-soluble salts will work according to the process of the present invention and hence should be considered within the scope of the present invention.

The term "pK value" as used herein can be represented by the formula $pK = -\log_{10}K$ wherein K is the dissociation constant of the acid in an aqueous solution. Typical of weak organic acids having a pK value of from about 3 to about 5 in which the anion moiety of such acid can be employed as the anion moiety of the before-defined water-soluble salt are as follows:

| Acid | pK value |
|---|---|
| acetic | 4.75 |
| formic | 3.75 |
| propionic | 4.87 |
| butyric | 4.8 |
| citric | 3.08 and 4.7 |
| maleic | 3.00 |

The combination of the sulfonated solution polymer and the before-defined water-soluble salts suitable for use in practicing the present invention form a hydrophilic film upon drying. However, if one desires to impart shrinkage control as well as durable soil release characteristics to the polyester textile substrate it may be desirable to cure the fabric containing the polymer and the salt constituent. Any suitable curing procedure can be employed. It may, for instance, be desirable that the textile material containing the copolymer and the salt constituent first be dried to remove water. Thereafter, the dried fabric may be heated to a temperature of about 300° F. to about 450° F., preferably about 350° F. to about 390° F. for a period of time sufficient to substantially cure the copolymer. Alternatively heating and curing may be accomplished in a one step simultaneous operation. Curing may substantially enhance the durability of the soil release and shrinkage control characteristics imparted to the polyester fibers of the textile substrate by the copolymer and the before-mentioned salt-constituent.

As previously stated, the copolymer constituents useful in the practice in the present invention are condensation polymers and thus as such contain varying amounts of solids. Normally, it is desirable that the fabric contain from about 0.05 to about 5 percent, preferably from about 0.2 to about 1 weight percent solids of the polymer. Further, sufficient water-soluble salt is incorporated into the solution so as to provide at least about 10 percent, preferably about 20 percent by weight of the water-soluble salt constituent based on the weight of the polymer, e.g., from about 20 to about 25 weight percent. The aqueous solution consisting essentially of the polymer and the water-soluble salt in which the cation moiety is as previously defined should be present in the pad bath in a sufficient amount so that at least about 0.05 weight percent of acid polymer solids and water-soluble salt is applied to the substrate, based on the dry weight of the textile substrate, e.g., from about 0.05 to about 5 percent, preferably from about 0.02 to about 1 weight percent.

The bath used to impregnate the textile material according to the present invention is not limited to include only the essential ingredients heretofore mentioned, e.g., the copolymer and the water-soluble salt of the before-mentioned polyvalent ion. In addition, other ingredients may be employed such as, for example, emulsifying agents, wetting agents, softeners and the like, and numerous other compounds that, for instance, enhance the physical characteristics of the fabric, or which impart stability to the pad bath. The bath may be conveniently applied to the substrate by padding of the bath onto the fabric.

In employing the process of the present invention the water may be removed from the wetted textile substrate prior to curing the polymeric constituent containing the salt constituent onto the textile substrate, or drying and curing may be done simultaneously. If a two-step drying and curing operation is desired, the drying temperatures employed should be high enough to economically and effectively remove the water constituent of the aqueous emulsion but should not be so high to initiate curing of the copolymer and salt constituent. In general, however, the drying step can be accomplished by subjecting the wet textile material to an elevated temperature for a period of time effective to remove substantially all of the water from the textile material. The drying temperature range set forth may overlap to some degree with the curing temperature range.

In order to more explicitly illustrate the subject invention, the following examples are given. These examples are not intended to limit the scope of the present invention but are merely set forth to provide direction to one skilled in the art. Unless otherwise stated, parts set forth in the examples are parts by weight.

In all of the following examples unless otherwise indicated a pad bath solution was prepared containing water, 0.5 percent (solids) of a sulfonated polyester polymer as indicated in the particular example and 0.25 percent hydrated magnesium chloride ($Mg\ Cl_2.6H_2O$). In each of the examples the padding solution was padded onto a sample of 100 percent texturized polyester doubleknit fabric to a 100 percent wet pick-up and the fabric was then dried at a temperature of 250° F. for 3 minutes and thereafter the polymer constituent was cured at 370° F. for 1 minute. The treated fabric contained 0.5 percent of the polymer constituent in each instance and 0.25 percent of the salt component based on the weight of the polymer.

A sample of the fabric in each example was then stained prior to washing with about 0.5 grams of Nujol (mineral oil), washed according to AATCC Method Number 130–1970, at 120° F. The stain was then cut out and extracted with hexane to remove the residual oil and the results are reported in the table in the column labeled "0/1" as the percent oil remaining after one washing. Separate samples were washed 4 times, stained in the same manner, washed again and then extracted with hexane to determine soil release after several washings and the results of these tests are reported in the column labeled "4/5". Moisture transport characteristics are reported under the heading so labeled in the table. Results are provided for samples measured prior to any washing ("0"), after 1 washing ("1") and after 5 washings ("5"). Results are reported pursuant to a standard moisture transport test, well known in the art as the time in seconds for one drop of water dropped on a treated sample to disappear and become completely absorbed into the fabric.

EXAMPLE 1

In this example the above process was followed using as the sulfonated polyester 3M's brand Release FC 227 which is a copolymer of terephthalic acid and ethylene glycol containing repeating units of a sulfonated benzene dicarboxylic acid. It is a water-soluble, anionic, hygroscopic, wicking, stain release product. The soil release and moisture transport characteristics are reported in the table.

EXAMPLE 2

The same procedure was followed as in Example 1 except that the magnesium salt was deleted from the padding composition. As the results reported in the Table indicate, the soil release level was not nearly as good either prior to washing or after multiple washings in the absence of the magnesium salt, and the moisture transport characteristics became poor, especially after 5 washes.

EXAMPLES 3–4

In these examples the sulfonated polyester employed was Eastman's W.D. 3652 Size. The Size is a linear water dispersible polyester wherein most of the end groups in the molecular chain are primary hydroxyl groups. Positioned along the chain at random intervals are sodium sulfonate groups (—$SO_3NA$), which contribute to water dispersibility. The polymer has an average molecular weight of about 10,000, is translucent in appearance, has a pH of 6–8 and a solution viscosity, cP(mPa.s)$^e$ at 20 rpm's of 18. In Example 3 the W.D. Size was employed with the magnesium salt and in Example 4 the same procedure was followed with no magnesium salt present. The results are reported in the Table.

EXAMPLES 5–6

In examples 5–6 the sulfonated polyester employed was Eastman's MPS 7762. The polymer has the same general structure as the W.D. 3652 Size reported in Examples 3 and 4, with an average molecular weight of about 7,000, a pH of 5–6 and a solution viscosity cP(mPa.s)$^e$ at 20 rpm's of 16. The product includes about 10 weight percent of a polyethylene glycol plasticizer. The results are reported in the Table.

EXAMPLES 7–8

In Examples 7–8 the sulfonated polyester employed was Eastman's WJL 3642 Size. The general characteristics of the polymer are similar to that reported for the WD 3652 Size, the polymer having a molecular weight of about 16,000, pH of 6–8, and a solution viscosity of 20 rpm's of about 10. In Example 7 the size was employed with the magnesium salt, and in Example 8 the same procedure was followed except that the magnesium salt was omitted. The results are repeated in the Table.

EXAMPLES 9–10

In Examples 9–10 the size employed was Eastman's FPY 6762. The general characteristics of the polymer are similar to that reported for W.D. 3652 in Examples 3–4. The polymer has a molecular weight of about 3500, a pH of about 5–6, a glass transition temperature of 32 and a solution viscosity of 26. In Example 9 the size was employed with the magnesium salt and in Example 10 the same procedure was followed with the omission of the magnesium salt. The results are reported in the Table.

EXAMPLE 11

Example 11 was a control, and measured the soil release and moisture transport properties of the base fabric to which no sulfonated polyester or magnesium salt was applied. The results are set forth in the Table.

EXAMPLE 12

In this example no sulfonated polyester was provided in the pad bath. Instead the bath contained a 0.5 percent by weight on a solids basis of a synthetic acid emulsion copolymer prepared by the emulsion polymerization of 80 parts methyl acrylate, 20 parts acrylic acid and 1.2 parts N-methyol acrylamide. The magnesium salt was also employed. This pad bath composition is of the type described and claimed in U.S. Pat. No. 4,131,550 to Marco, assigned to Milliken Research Corporation. As can be seen while the acid emulsion polymer provided generally good soil release characteristics, these characteristics after multiple washings were less desirable than initially although still much better than those for the control sample. Also, the moisture transport characteristics tended to become less desirable after 1 and 5 washes than was the case when a sulfonated polyester was employed.

TABLE

| EXAMPLE NO. | SULFONATED POLYESTER | MAGNESIUM SALT PRESENT | SOIL RELEASE (%) 0/1 | SOIL RELEASE (%) 4/5 | MOISTURE TRANSPORT (SECONDS) 0 | MOISTURE TRANSPORT (SECONDS) 1 | MOISTURE TRANSPORT (SECONDS) 5 |
|---|---|---|---|---|---|---|---|
| 1 | Release FC-227 | Yes | 0.4 | 0.4 | <1 | <1 | <1 |
| 2 | Release FC-227 Fabric Protector | No | 2.2 | 2.2 | <1 | 3 | >10 |
| 3 | W.D. 3652 | Yes | 0.4 | 0.4 | <1 | 4 | 2 |
| 4 | W.D. 3652 | No | 12.7 | 6.5 | >10 | 7 | >10 |
| 5 | MPS 7762 | Yes | 0.5 | 0.6 | 4 | >10 | 3 |
| 6 | MPS 7762 | No | 11.3 | 10.9 | 8 | >10 | >10 |
| 7 | WJL 6342 | Yes | 0.6 | 0.4 | 1 | >10 | >10 |
| 8 | WJL 6342 | No | 14.9 | 7.5 | 1 | >10 | >10 |
| 9 | FPY 6762 | Yes | 0.4 | 0.7 | <1 | >10 | 6 |
| 10 | FPY 6762 | No | 11.9 | 11.9 | 9 | >10 | >10 |
| 11 | None | None | 19.1 | 26.4 | >10 | >10 | >10 |
| 12 | Acid Emulsion Polymer | Yes | 0.7 | 1.3 | <1 | 8 | 8 |

Surprisingly it has been found that in the case of sulfonated polymers, not only are the soil release and moisture wicking properties generally improved by the presence of a water soluble salt such as magnesium chloride but these improved properties tended to be very durable and generally little or no deterioration was observed in the soil release properties even after five washings.

What is claimed is:

1. A process for imparting durable soil release and moisture wicking characteristics to a textile material comprising polyester fibers which comprises padding said textile material with an effective amount of a polymer solution comprising from about 0.05 to about 5 weight percent of a sulfonated polyester polymer and at least about 10 weight percent based on the weight of the polymer of a water-soluble salt wherein the cation moiety of said salt is a polyvalent metal ion selected from the group consisting of $Mg^{++}$, $Zn^{++}$, and $Ca^{++}$, so as to provide a resulting wet textile material containing at least about 0.05 weight percent solids, said solids being a combination of said copolymer and said salt; and drying said resulting wet textile material to remove substantially all of the water therefrom.

2. The textile material having durable soil release characteristics prepared according to the process of claim 1.

3. The process of claim 1 wherein said polymer is present in said solution in an amount of from about 0.2 to about 1 weight percent, said salt is present in an amount of at least about 20 weight percent based on the weight of the polymer, and said resulting wet textile material contains at least about 0.2 weight percent solids.

4. The process of claim 1 wherein said polyvalent metal ion is magnesium.

5. The textile material having durable soil release characteristics prepared according to the process of claim 4.

6. A process for imparting durable soil release and moisture wicking characteristics to a textile material comprising polyester fibers which comprises padding said textile material with an effective amount of a polymer solution comprising from about 0.05 to about 5 weight percent of a sulfonated polyester polymer and at least about 10 weight percent based upon the weight of the polymer of a water-soluble salt wherein the cation moiety of said salt is a polyvalent metal ion selected from the group consisting of $Mg^{++}$, $Zn^{++}$, and $Ca^{++}$, and the anion moiety of said salt is selected from the group consisting of halogen and the anion moiety of an organic acid in which the pK value of said organic acid is from about 3 to about 5, so as to provide a resulting wet textile material containing at least about 0.05 weight percent solids, said solids being a combination of said copolymer and said salt; and drying said resulting wet textile material to remove substantially all of the water therefrom.

7. The process of claim 6 which comprises the additional step of heating the dried textile material to a temperature sufficient to cure said polymer containing said salt.

8. A textile material having improved durable soil release and moisture wicking characteristics, which comprises: a textile material substrate formed of polyester fibers having applied thereto a soil release finish in an amount of at least about 0.05 weight percent on a solids basis based upon the weight of the textile material, said soil release finish comprising a sulfonated polyester polymer and at least about 10 percent by weight based upon the weight of the finish of at least one water soluble salt in which the cation moiety of said salt is selected from $Mg^{++}$, $Zn^{++}$, and $Ca^{++}$.

9. The textile material of claim 8, wherein said sulfonated polyester is a synthetically produced copolymer prepared by condensation polymerization of a di- or polycarboxylic acid and a glycol together with a sulfonated di- or polycarboxylic acid, said sulfonated acid provided in sufficient amounts in said copolymer to provide hydrophilic properties to said polyester fibers when applied thereto in conjunction with the use of said divalent metal salt.

10. The textile material of claim 9, wherein said di- or polycarboxylic acid is selected from phthalic, isophthalic, terephthalic and 1,4 hydro isophthalic dicarboxylic acids.

11. The textile material of claim 9, wherein said glycol is selected from ethylene glycol, diethylene, glycol, propylene glycol and 1,4 butanediol.

12. The textile material of claim 8, wherein the anionic moiety of said water soluble salt is selected from chloride, bromide, iodide, and an anion moiety of a weak organic acid having a pK value of from about 3 to about 5.

* * * * *